US008408306B2

(12) United States Patent
Arizmendi, Jr. et al.

(10) Patent No.: US 8,408,306 B2
(45) Date of Patent: Apr. 2, 2013

(54) PROCESSES AND SYSTEMS FOR TREATING OIL AND GAS WELLS

(75) Inventors: Napoleon Arizmendi, Jr., Magnolia, TX (US); Richard Paul Rubbo, The Woodlands, TX (US); Mark H. Yamasaki, Houston, TX (US)

(73) Assignee: Production Sciences, Inc., The Woodlands, TX (US)

( * ) Notice: Subject to any disclaimer, the term of this patent is extended or adjusted under 35 U.S.C. 154(b) by 0 days.

(21) Appl. No.: 13/555,774

(22) Filed: Jul. 23, 2012

(65) Prior Publication Data

US 2012/0273210 A1 Nov. 1, 2012

Related U.S. Application Data

(63) Continuation of application No. 13/266,127, filed as application No. PCT/US2010/032467 on Apr. 26, 2010.

(60) Provisional application No. 61/172,292, filed on Apr. 24, 2009.

(51) Int. Cl.
*E21B 34/06* (2006.01)
*E21B 43/12* (2006.01)

(52) U.S. Cl. ..... 166/310; 166/372; 166/167

(58) Field of Classification Search ..... 166/369, 166/372, 166, 167, 165, 310
See application file for complete search history.

(56) References Cited

U.S. PATENT DOCUMENTS

| | | | |
|---|---|---|---|
| 4,633,954 | A | 1/1987 | Dixon et al. |
| 4,791,990 | A | 12/1988 | Amani |
| 6,092,599 | A | 7/2000 | Berry et al. |
| 6,973,973 | B2 | 12/2005 | Howard et al. |
| 7,658,229 | B2 | 2/2010 | Becker et al. |
| 7,717,182 | B2 | 5/2010 | Butler et al. |
| 7,802,625 | B2 | 9/2010 | Daniels et al. |
| 2003/0141073 | A1 | 7/2003 | Kelley |

FOREIGN PATENT DOCUMENTS

| | | |
|---|---|---|
| EP | 1062405 | 6/2003 |
| RU | 2114284 | 6/1998 |
| WO | 2007003597 | 1/2007 |

*Primary Examiner* — David Andrews
(74) *Attorney, Agent, or Firm* — Ramey & Browning, PLLC

(57) ABSTRACT

Systems and processes are provided for removing fluid from a subterranean well and enhancing the production of oil and/or gas are herein disclosed. In one embodiment, the system includes an injection conduit, an injection valve, a relief valve, a container, a container valve, a return conduit valve, and a return conduit, all arranged within a subterranean well for removing at least one fluid from the well. The removal of at least one fluid from the well is controlled by the flow of gas into the injection conduit.

5 Claims, 6 Drawing Sheets

PROCESSES AND SYSTEMS FOR TREATING OIL AND GAS WELLS

CROSS REFERENCE TO RELATED APPLICATIONS

This application claims priority from U.S. provisional application No. 61/172,292, entitled "PROCESS AND SYSTEM FOR TREATING OIL AND GAS WELLS" filed on Apr. 24, 2009 which is incorporated by reference in its entirety, for all purposes, herein.

FIELD OF TECHNOLOGY

The present disclosure generally relates to novel and non-obvious systems and processes for treating oil and gas wells to enhance production and recovery of hydrocarbons from subterranean formations. More specifically, the present disclosure is directed to systems and processes for removing fluids from oil and/or gas wells.

BACKGROUND

Oil and gas are produced from wells penetrating subsurface hydrocarbon-bearing formations or reservoirs. Such reservoirs can be found at various depths in the subsurface of the earth. In gas-producing reservoirs, the gas and/or oil contained therein is compressed by the weight of the overlying earth. When the formation is breached by a well, the gas tends to flow into the well under formation pressure. Any other fluid in the formation, such as connate water trapped in the interstices of the sediments at the time the formation was deposited, also moves toward the well. Production of fluids from the well continues as long as the pressure in the well is less than the formation pressure. Eventually production slows and/or ceases either because formation pressure equals or falls below well pressure (borehole pressure). In the latter case, it has often been found that interstitial water filling the well exerts sufficient pressure to stop or sharply reduce production. A problem arises when the expense of removing the water becomes a substantial portion of, or exceeds the value of the hydrocarbon produced, thereby making it uneconomical to operate the gas and/or oil well. At times, up to 60% of the oil and or gas reserves may still be in the formation.

Many conventional approaches for removing liquid from an oil and gas well are disclosed in the prior art. Piston pumps are common and require either an electric or gas powered motor which is coupled by belts or gears to a reciprocating pump jack. The reciprocating motion of the pump jack, in turn, reciprocates a piston within a cylinder disposed within the well. As the piston reciprocates within the well, valves open and close, creating a low pressure in the well and drawing the oil to the surface. Centrifugal or rotary pumps, often found in water wells, also operate by either an electric or gas powered motor. Usually, the pump is attached directly to the shaft of the motor. The rotary motion of the veins reduces pressure in the well, thereby causing the fluid to flow up the well.

Major disadvantage with both piston and centrifugal pumps include mechanical fatigue and failure of moving parts and high maintenance and repair costs. Furthermore, such systems require large amounts of electricity or fuel to operate, making them more costly than passive systems. Typically, the expense of maintaining and operating such systems will eventually exceed the economic benefits returned and result in the well being shut in with up to 60% of the reserves still within the formation.

In gas producing wells another major disadvantage of conventional pumps such as electrically submersible pumps, is that their efficiency can be very low unless enough hydrostatic head is provided. In gas wells it is often valuable to totally remove the standing fluid to near the bottom of the wellbore where there is simply not enough allowable fluid column height and therefore not enough hydraulic head to allow such pumps to effectively operate. Furthermore, the well accumulation rate of liquids in gas wells can be very much lower than the rate at which such pumps must run which can result in a high frequency of pump shutdown events and an increased risk of such pumps running dry and burning up.

Therefore, there remains a long-felt need in the field of art for improved systems and processes for extracting fluid from a wellbore.

SUMMARY

In general, various embodiments of the present disclosure relate to systems and processes for removing fluid from a subterranean well or wellbore. The process and systems can include gas unloading lift production systems (GULPS) and related systems and processes for removing fluids from a subterranean well or wellbore. In various embodiments, the wellbore is a well for producing oil and/or gas. In various embodiments, the system or tool for removing fluid from the wellbore is run downhole in a production string. In various further embodiments, oil and/or gas from the well is capable of being produced from the production string and/or the annulus of the wellbore while fluid removal system or tool is being used.

In one embodiment of the present disclosure, a system for removing fluid from a subterranean well is provided. The system includes a container positioned in a subterranean well; a gas injection conduit in fluid communication with the container for providing a fluid path for injecting an injection gas from an earth surface proximate location into the container; a fluid return conduit in fluid communication with the container for providing a fluid path for transferring at least one subterranean fluid from the container to an earth surface proximate location; a first valve that defines an interface between the gas injection conduit and the container; a second valve that defines an interface between the subterranean well and the container; a third valve that defines an interface between the fluid return conduit and the container; and a fourth valve that defines an interface between the subterranean well and the container. The second valve is positioned on the system at subterranean depth above the fourth valve. In operation, the fourth valve is positioned at an initial subterranean depth below a standing level of the at least one subterranean fluid to be removed from the subterranean well. The system is configurable in a first valve orientation, wherein the first valve and the third valve are closed, and the second and fourth valve are open; and a second valve orientation, wherein the first valve and the third valve are open, and the second valve and fourth valve are closed.

In another embodiment of the present disclosure, a process for removing fluid from a subterranean well includes positioning a container in a subterranean well, wherein the container comprises a fluid entry valve for providing a fluid entry point to the container and a fluid exit valve for providing a fluid exit point from the container; injecting an injection gas into the container to cause the fluid entry valve to open and allow at least one subterranean fluid from the subterranean well to enter the container; permitting the pressure within the container to reach a reference pressure, wherein the reference pressure causes the fluid entry valve to close and the fluid exit valve to open; and permitting the at least one fluid to flow up the subterranean well.

In another embodiment of the present disclosure, a process for removing fluid from a subterranean well includes positioning a fluid removing system in the subterranean well. The system can include a container positioned in a subterranean well; a gas injection conduit in fluid communication with the container for providing a fluid path for injecting an injection gas from an earth surface proximate location into the container; a fluid return conduit in fluid communication with the container for providing a fluid path for transferring at least one subterranean fluid from the container to an earth surface proximate location; a first valve that defines an interface between the gas injection conduit and the container; a second valve that defines an interface between the subterranean well and the container; a third valve that defines an interface between the fluid return conduit and the container; and a fourth valve that defines an interface between the subterranean well and the container. The second valve is positioned on the system at subterranean depth above the fourth valve. The system can further include a hydraulic umbilical for sending hydraulic power signals to actuate the valves of the system and a gas holding chamber pre-charged with gas to be injected through the injection conduit. During injection the injection conduit and the hydraulic umbilical can be at least partially filled with the injection gas.

The process further includes injecting an injection gas through the gas injection conduit and into the container at an injection pressure; increasing the injection pressure to a first pressure that is greater than a reference pressure by a first set value to cause the first valve to open and the second valve to close; and reducing the injection pressure to a second pressure that is greater than the reference pressure by a second set value whereby the second set value is less than the first set value to cause the first valve to close, the second valve to open and the at least one subterranean fluid to enter the container from the subterranean well.

The reference pressure can be a pressure at a position within the subterranean well, a pressure at a position within the container a pressure at a position within the return conduit, a pressure at a position within the gas holding chamber, a pressure at a position within the hydraulic umbilical.

The first set value and the second set value of injection pressure can be defined and set prior to positioning the system in the subterranean well by preloading at least one compression spring associated with one or more valves of the system. The injection pressure can be maintained at the second set value for a period of time sufficient to displace the injection gas from the container and into the return conduit, thereby providing a gas lift assist force to lift the at least one subterranean liquid up the return conduit.

Various embodiments of the present disclosure relate to systems and processes for removing at least one fluid from a wellbore, or borehole, comprising the cooperation of four valves; a first valve; a second valve, a third valve and a fourth valve, wherein a fourth valve is open at a fourth pressure that is equal to or less than the wellbore's hydrostatic pressure, and wherein a second valve is open at a second pressure that is equal to or greater than fourth pressure, and wherein a first valve is open at a first pressure that is equal to or greater than the second pressure, and wherein the third valve is open at a third pressure that is greater than the third pressure. In various embodiments, the pressures are cycled to remove the desired amount of at least one fluid.

In various embodiments, the second pressure closes or begins to close the second valve, but the second valve is closed at least by the third pressure. In various further embodiments, the third pressure closes the second valve. Typically, the second valve is closed at a pressure between the second pressure and the third pressure.

In various embodiments, the first pressure closes or begins to close the fourth valve, but the fourth valve is closed at least by the second pressure. Typically, the fourth valve is closed at a pressure between the first pressure and the second pressure. In various further embodiments, the second pressure closes the fourth valve.

In various embodiments, the third pressure opens or begins to open the third valve. Typically, the third valve is closed at a pressure lower than the third pressure. However, in various embodiments, a pressure between the first pressure and the third pressure opens the third valve. In various further embodiments, a pressure between the second pressure and the third pressure opens the third valve. The third valve is the return valve and is capable of remaining open in various embodiments.

As such, further embodiments comprise a first valve means, a second valve means, a third valve means, a fourth valve means and a container means for removing at least one fluid, from a wellbore, or borehole.

Various embodiments of the present disclosure comprise arrangements of the first valve, the second valve, the third valve, and the fourth valve into systems for removing at least one fluid from a borehole and/or wellbore.

Systems of various embodiments of the present disclosure comprise umbilical wellbore tools for the efficient gas-assisted removal of fluids from the wellbore to increase and/or enhance the production of oil and/or gas from a formation with a surprising improvement over the prior art that the system can be operated by solely the injection conduit, by controlling the flow of gas through the system. In an embodiment, systems of the present disclosure allow for the gas-assisted removal of a portion of up to 60% of the oil and/or gas that is trapped within the formation. In various formations, only about 50% of the oil and/or gas is trapped. In alternate formations, only about 40% of the oil and/or gas is trapped. In alternate formations, only about 30% of the oil and/or gas is trapped.

Utilizing systems of the present disclosure is expected to remove up to 75% of the oil and/or gas that is trapped. In an alternate embodiment, systems of the present disclosure are expected to remove up to 50% of the oil and/or gas that is trapped. In an alternate embodiment, systems of the present disclosure are expected to remove up to 40% of the oil and/or gas that is trapped. In an alternate embodiment, systems of the present disclosure are expected to remove up to 30% of the oil and/or gas that is trapped. In an alternate embodiment, systems of the present disclosure are expected to remove up to 25% of the oil and/or gas that is trapped. In an alternate embodiment, systems of the present disclosure are expected to remove up to 20% of the oil and/or gas that is trapped. In an alternate embodiment, systems of the present disclosure are expected to remove up to 15% of the oil and/or gas that is trapped.

In various embodiments, various systems of the present disclosure comprise, in various embodiments in combination, an injection conduit, a injection valve, a relief valve, a container, a container valve, a return conduit valve, and a return conduit, all arranged within a wellbore for removing a fluid from the wellbore or borehole. Further embodiments comprise a source of high pressure gas, such as a compressor, pump, storage container, the output of high pressure a gas producing well, and/or the like. The injection conduit is in fluid communication with a high pressure gas source. The injection valve controls and maintains the pressure of the gas within the injection conduit. In various embodiments, the relief valve allows compressed gas into the container when in at least one orientation and the relief valve allows the high pressure gas to bleed-off or expel into the wellbore in an at least one alternate orientation. In various embodiments, the container provides a chamber for collection of fluid from the wellbore. In various embodiments, the container can be a vessel, a drum, a pipe, a formation structure, a mandrel, a composite material, and/or the like. In various embodiments, the container valve allows the container to be filled with fluid from the wellbore when open and can be closed to facilitate removing the fluid from the wellbore. In various embodiments, the return valve allows fluid and or gas into the return conduit when the return valve is open and prevents the fluid from the wellbore from flowing back into the container when the return valve is closed. In various embodiments, the return conduit is a channel for removal of the fluid from the wellbore.

One aspect of the disclosure is to provide a simple umbilical gas-assisted process for removing fluid from an oil and/or gas well in order to stimulate oil and/or gas production. The fluid removal process includes the unique steps of lowering the water level in the well by locating the lower end of a return conduit associated with a system of the present disclosure below the fluid level in the well, and placing the upper end in fluid communication with a fluid exhaust line at the surface, while only controlling the introduction of high pressure gas to the injection conduit associated with a system of four valves of the present invention.

Typically, the fluid sought to be removed comprises water. However, various embodiments of the present disclosure can be used to remove any fluid desired. Fluid in the well is allowed into a container and then selectively into a return conduit. Once in the container, the fluid is prevented from flowing back out of the container by increasing the pressure in the container before removing the fluid through the return conduit.

The steps are capable of being repeated as necessary to lower the at least one fluid, such as water, in the well to a predetermined point or a desired point, thereby allowing the oil and/or gas in the formation to flow more freely and enhancing the production of oil and/or gas.

Various embodiments of the present disclosure provide inexpensive ways (or processes) for removing water from an oil and/or gas well to maximize oil and/or gas production. The systems and processes also provide a relatively maintenance free system for removing water when contrasted with continuously operating mechanical pumping systems. As a result, the extraction of the water using the lift assembly results in improved gas production with fewer maintenance costs, and a more rapid payoff of the lift assembly.

As such, in an embodiment of a system of the present disclosure for removing at least one fluid from a wellbore, the process comprises the steps of: lowering a fluid removing system into a wellbore, the system comprising in combination, an injection conduit, a injection valve, a relief valve, a container, a container valve, a return conduit valve, and a return conduit; wherein the container valve is open, or at least partially open, when the wellbore hydrostatic pressure is greater than the pressure of a gas in the container thereby at least partially filling the container with the at least one fluid; injecting gas into the injection conduit of the fluid removing system wherein the pressure injected is sufficient to at least partially open the injection valve thereby allowing access to the container; filling the container with a sufficient volume of the gas to pressurize the container and close the container valve while retaining the at least one fluid in said container; pressurizing said container's contents to a third pressure sufficient to overcome the hydrostatic pressure of the fluid column in the return conduit and open a return valve whereby at least a portion of the at least one fluid is removed along a return conduit connected to the return valve. In various further embodiments, the relief valve begins to open when the pressure in the container is less than the third pressure. In various other embodiments, the relief valve is open when the pressure in the container is greater than or equal to the wellbore's hydrostatic pressure.

These and other objects, advantages, purposes and features of the disclosure will become more apparent from a study of the following description taken in conjunction with the drawing figures described below.

Various further embodiments of the present disclosure comprise methods for producing oil and/or gas from a production string while simultaneously removing at least one fluid from the wellbore and/or borehole comprising the steps of lowering a device as herein disclosed into the production string of a wellbore and/or borehole; removing at least one fluid as herein disclosed; and, producing oil and/or gas through the production string. In an alternate embodiment, oil and/or gas is produced from the annulus of the wellbore and/or borehole. In an alternate embodiment, oil and/or gas is produced from both the annulus and the production string. Typically, embodiments of the present disclosure are sized to fit within a production string while leaving adequate room for other devices to be lowered and to allow production.

Yet further embodiments disclose gas assisted lift systems for moving a fluid uphole in a wellbore, said system comprising a gas supply; an injection conduit; an injection valve; a container comprising a container valve and a relief valve; a return conduit valve; and a return conduit, wherein said injection conduit's upstream end is connected to said gas supply and wherein said injection conduit's downstream end is connected across said injection valve to said container, further wherein said return conduit's downstream end is located uphole on the surface of said wellbore and wherein said return conduitis upsteam end is connected across said return valve to said container, further wherein each of said relief valve, said container valve, said return conduit valve and said injection valve are capable of control by gas injected from said gas supply, such that pressurizing said injection conduit to a first pressure opens said injection valve, closes, or begins to close, said container valve when said container is pressurized to a second pressure, opens, or begins to open, said return conduit valve when said container is pressurized to a third pressure, and opens said relief valve at a fourth pressure, wherein said third pressure which greater than said second pressure which is greater than or equal to said first pressure which is greater than or equal to said fourth pressure. Further embodiments disclose systems that are run in a production string of a wellbore and/or borehole. Still further embodiments disclose systems that produce oil and/or gas from the production string while the system is deployed.

The foregoing and other objects, features and advantages of the present disclosure will become more readily apparent from the following detailed description of exemplary embodiments as disclosed herein.

DEFINITIONS

The following definitions and explanations are meant and intended to be controlling in any future construction unless clearly and unambiguously modified in the following Description or when application of the meaning renders any construction meaningless or essentially meaningless. In cases where the construction of the term would render it meaningless or essentially meaningless, the definition should be taken from Webster's Dictionary, 3rd Edition. Definitions and/or interpretations should not be incorporated from other patent applications, patents, or publications, related or not, unless specifically stated in this specification or if the incorporation is necessary for maintaining validity.

As used herein, the term "downhole" means and refers to a location within a borehole and/or a wellbore. The borehole and/or wellbore can be vertical, horizontal or any angle in between.

As used herein, the term "uphole" means and refers to a location towards the surface, or origin of a borehole and/or wellbore. The borehole and/or wellbore can be vertical, horizontal or any angle in between.

As used herein, the term "borehole" means and refers to a hole drilled into a formation.

As used herein, the term "annulus" refers to any void space in an oil well between any piping, tubing or casing and the piping, tubing or casing immediately surrounding it. The presence of an annulus gives the ability to circulate fluid in the well, provided that excess drill cuttings have not accumulated in the annulus preventing fluid movement and possibly sticking the pipe in the borehole.

As used herein, the term "valve" means and refers to any valve, including, but not limited to flow regulating valves, temperature regulating valves, automatic process control valves, anti vacuum valves, blow down valves, bulkhead valves, free ball valves, fusible link or fire valves, hydraulic valves, jet dispersal valve, penstock, plate valves, radiator valves, rotary slide valve, rotary valve, solenoid valve, spectacle eye valve, thermostatic mixing valve, throttle valve, globe valve, one-way or two way check valves, one way or two way pressure relief valves, combinations of the aforesaid, and/or the like.

BRIEF DESCRIPTION OF THE FIGURES

Embodiments of the present disclosure are described, by way of example only, with reference to the attached Figures and are therefore not to be considered limiting the scope of the present disclosure or embodiments provided herein.

DETAILED DESCRIPTION

Figure 1:
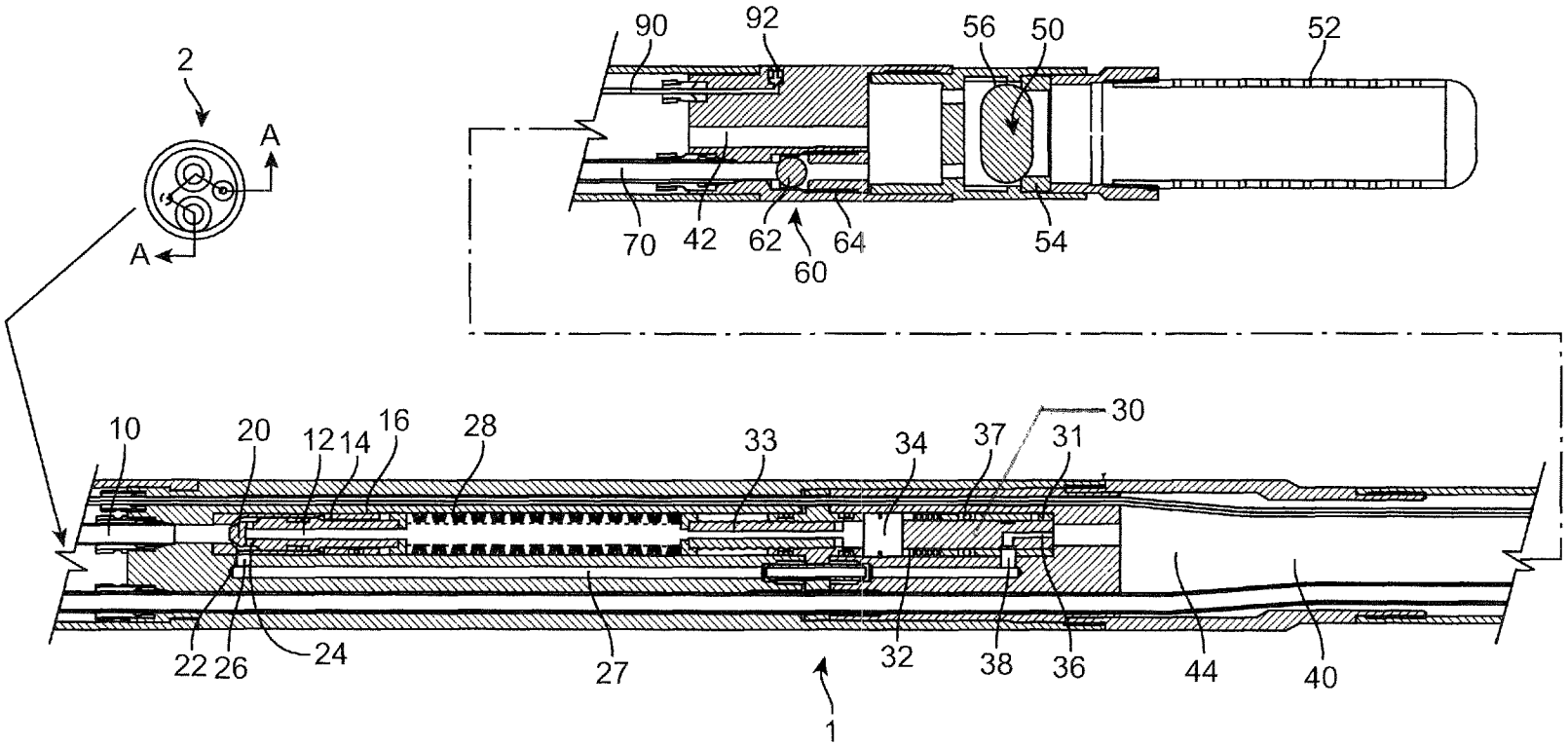
FIG. 1 illustrates a cross sectional view of an exemplary system for removing fluid from a wellbore according to one embodiment.

In the following description, certain details are set forth such as specific quantities, sizes, etc. so as to provide a thorough understanding of the present embodiments disclosed herein. It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, methods, procedures and components have not been described in detail so as not to obscure the embodiments described herein.

Systems and processes for removing fluids from a wellbore are known in the art. Various examples of prior art systems and processes include U.S. Pat. No. 7,464,763; U.S. Pat. No. 7,445,049; U.S. Pat. No. 6,691,787; U.S. Pat. No. 6,629,566; U.S. Pat. No. 5,806,598; and, U.S. Pat. No. 5,339,905, the contents all of which are hereby incorporated by reference in their entirety.

For purposes of description herein, the terms "upper," "lower," "right," "left," "rear," "front," "vertical," "horizontal," and derivatives thereof shall relate to the orientations depicted in FIG. 1. However, it is to be understood that the disclosure may assume various alternative orientations. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

FIG. 1 illustrates a cross sectional view of an exemplary system 1 for removing fluid from a wellbore according to one embodiment. System 1 can be, for instance a gas unloading lift production system (GULPS) 1. Cross section 2 illustrates the sectional view of system 1 along line A-A. System 1 includes an injection conduit 10, an injection valve 20, a relief valve 30, a container 40, a container valve 50, a return conduit valve 60, and a return conduit 70. In various embodiments, an intake section 52 is capable of use. Typically, intake section 52 comprises at least one intake port for filling container 40. System 1 can be deployed and arranged within a wellbore for removing a fluid from the wellbore. In various embodiments, system 1 is connected through an umbilical arrangement of conduits to a fluid removal system (shown in FIG. 2) and a high pressure gas source (also shown in FIG. 2).

The injection valve 20 of system 1 can include a plug 24, a plug seat 22, an injection valve biasing member 28, a side port 26, and a vent line 27. A series of seals and/or vent ports can be used to facilitate operation of the injection valve 20, such as a first injection valve seal 12, a second injection valve seal 14, and a vent port 16. Additional seals and vent ports may also be use if desired. Typically the injection valve 20 is biased or opened with pressurized gas deflecting a compression spring 28 within the valve that has been set to a predetermined load and spring rate based on the wellbore depth and the system parameters.

The relief valve 30 of system 1 can include a relief port 31, a spool biasing member 32, a spool 34, an adjustment rod 33, a container gas port 38, and a container gas line 36. Likewise, a series of seals and/or vent ports can be used to facilitate operation of relief valve 30, such as a first relief valve seal 37. Additional seals and vent ports can also be use if desired.

An adjustment rod 33 can be used to increase or decrease the length between the injection valve 20 and the relief valve 30 and to change the opening pressure of the injection valve.

In an exemplary embodiment, the adjustment rod 33 is a screw type of device that can be screwed in or out for adjustment. The adjustment rod 33 can also be a receptacle for accepting one or more washers to increase the length between the injection valve 20 and the relief valve 30. The adjustment rod 33 can be manipulated manually or automatically, for example with a solenoid motor, pneumatic motor, hydraulic pressure, and/or any other automated means for adjusting the position of the adjustment rod 33.

A container 40 of system 1 depicted in FIG. 1, can include a volume of isolatable space 44, at least one container vent 31, and a container relief line 42. The container 40 can be constructed with any desired volume of isolatable space 44. Design characteristics of the system 1 that can be used in determining a size of the container 40 include, but are not limited to the amount of fluid to be removed from the wellbore, the viscosity of the fluid to be removed, the volume of high pressure gas needed to operate the system 1, the depth of the formation within which the wellbore is drilled, and other system, formation and operation parameters such as pressure, temperatures, materials of construction and the like.

The container valve 50 of system 1 can include a spool container plug 56 and container plug seat 54. Likewise, one or more seals and/or vent ports can be used to facilitate operation of the container valve 50.

A return valve 60 of system 1 can include a plug 62, a plug seat 64, and a return conduit 70. Fluid withdrawn from the wellbore and conveyed through the return conduit 70 can be distributed or stored by any means, such as a treatment facility, storage tank, through venting, and/or the like.

Additional components of system 1 depicted in FIG. 1 include a measurement conduit 90 and a check valve 92. The measurement conduit 90 can be used for conveying any necessary instrumentation downhole, including, but not limited to a fluid, i-wire, a fiber optic cable, and/or any other instrumentation cable or control line for taking measurements, providing power, or device or tool necessary for operation of system 1 or operable with system 1. Measurement devices conveyed down the measurement conduit 90 can measure parameters including, but not limited to temperatures, pressures, fluid density, fluid depth and/or other conditions of fluids or areas proximate to or in various portions of the formation or wellbore. Additionally, fluids, chemicals, and/or other substances may be injected or conveyed downhole through the measurement conduit 90.

Figure 2:
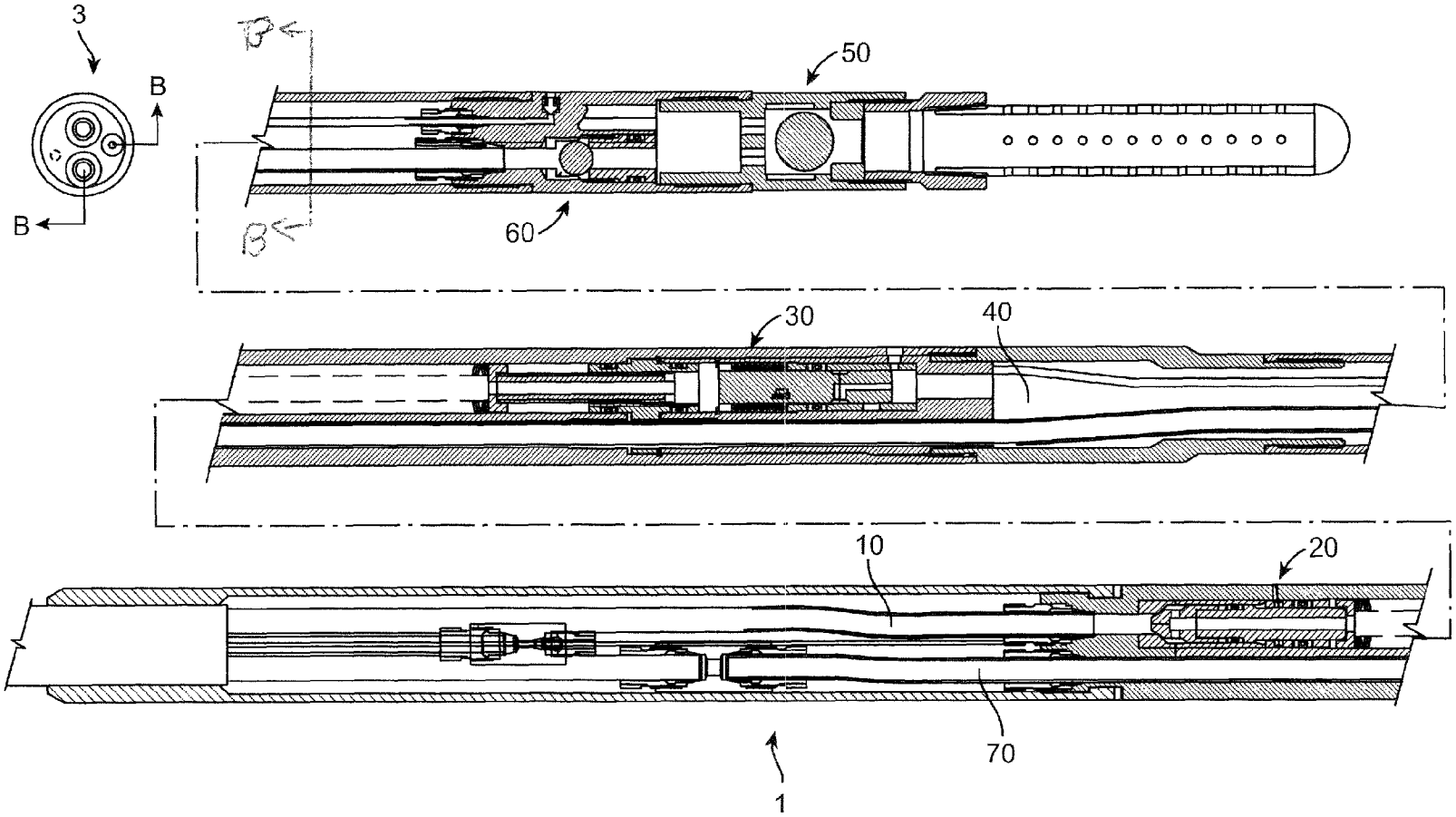
FIG. 2 illustrates a cross sectional view of an exemplary system for removing fluid from a wellbore according to another embodiment.

FIG. 2 is an illustration of a different cross sectional view of an exemplary umbilical arrangement of system 1 depicted in FIG. 1. Cross section 3 illustrates the sectional view along line B-B of system 1 in a three-pack umbilical configuration. System 1 can include an injection conduit 10, an injection valve 20, a relief valve 30, a container 40, a container valve 50, a return conduit valve 60, and a return conduit 70, all deployed and positioned within a wellbore for removing a fluid from the wellbore. At least one flat pack (illustrated and described in reference to FIG. 4) can be arranged within the well closer to the surface and above the tool 1 for removing fluid from the wellbore.

The systems 1 for removing a fluid from a subterranean well or wellbore herein disclosed can further include an actuator for opening, closing, rotating or otherwise controlling the orientation of the valves 20, 30, 50, 60 of system 1. The actuator can include one or more hydraulic actuators, electric actuators, mechanical actuators, combinations thereof or any other actuator capable of controlling the orientation of valves 20, 30, 50, 60 of system 1. One or more umbilical can be run downhole from the surface to provide signals to the actuator to control the orientation of valves 20, 30, 50, 60 of system 1.

In one embodiment the actuator is a hydraulic actuator for controlling the orientation of valves 20, 30, 50, 60 of system 1. System 1 can further include one or more hydraulic umbilical through which a hydraulic power signal or force can be transmitted to the actuator from the earth surface. The actuator controls the orientation of valves 20, 30, 50, 60 of system 1 in response to the hydraulic power signal or force.

The hydraulic actuator can be configured to control the orientation of valves 20, 30, 50, 60 in response to a differential pressure between a pressure of a first hydraulic umbilical and a pressure at a point within the subterranean well. The hydraulic actuator can be configured to control the orientation of valves 20, 30, 50, 60 in response to a differential pressure between a pressure within a first hydraulic umbilical and a pressure within the injection conduit 10. The hydraulic actuator can be configured to control the orientation of valves 20, 30, 50, 60 in response to a differential pressure between a pressure within a first hydraulic umbilical and a pressure within the return conduit 70. The hydraulic actuator can be configured to control the orientation of valves 20, 30, 50, 60 in response to a differential pressure between a pressure within a first hydraulic umbilical and a pressure within a second hydraulic umbilical.

System 1 can further include a gas holding chamber precharged with the injection gas for injecting gas through the injection conduit 10 and into the container 40. The hydraulic actuator can be configured to control the orientation of valves 20, 30, 50, 60 in response to a differential pressure between a pressure within a first hydraulic umbilical and a pressure of the gas holding chamber.

In another embodiment, the hydraulic power signal can be sent through the gas injection conduit 10 from the earth surface. The hydraulic actuator can be configured to control the orientation of valves 20, 30, 50, 60 in response to a differential pressure between a pressure within the gas injection conduit 10 and a pressure at a point within the subterranean well. The hydraulic actuator can be configured to control the orientation of valves 20, 30, 50, 60 in response to a differential pressure between a pressure within the gas injection conduit 10 and a pressure within the container 40. The hydraulic actuator can be configured to control the orientation of valves 20, 30, 50, 60 in response to a differential pressure between a pressure within the gas injection conduit 10 and a pressure within the return conduit 70. The hydraulic actuator can be configured to control the orientation of valves 20, 30, 50, 60 in response to a differential pressure between a pressure within the gas injection conduit 10 and a pressure within a hydraulic umbilical. The hydraulic actuator can be configured to control the orientation of valves 20, 30, 50, 60 in response to a differential pressure between a pressure within the gas injection conduit 10 and a pressure within a gas holding chamber.

In yet another embodiment, the actuator is an electric actuator for controlling the orientation of valves 20, 30, 50, 60 of system 1. The electric actuator can be a solenoid, an electric motor, or an electric pump driving a piston actuator in a closed-loop hydraulic circuit. System 1 can further include one or more electrically conductive umbilical through which an electric power signal can be transmitted to the actuator from the earth surface. The actuator controls the orientation of valves 20, 30, 50, 60 of system 1 in response to the electric power signal.

In one embodiment, an actuator for controlling the orientation of valves 20, 30, 50, 60 of system 1 includes a communications receiver for receiving a communication signal, a local electrical power source for powering the actuator, a controller responsive to the communication signal, and a sensor interfaced with the controller for providing an indication of the presence of at least one subterranean fluid to be removed from a the subterranean well.

In one embodiment, the receiver is an acoustic receiver and the communication signal is an acoustic signal generated at an earth surface, a wellhead of the subterranean well or other remote location. In another embodiment, the receiver is an electromagnetic receiver and the communication signal is an electromagnetic signal generated at earth surface, a wellhead of the subterranean well or other remote location.

The local electrical power source for powering the actuator is can be a rechargeable battery, a capacitor, or an electrically conductive cable energized by a power supply located at earth surface, a wellhead of the subterranean well or other remote location.

The controller of the actuators of the present disclosure can include a programmable microprocessor. The microprocessor can be programmed to operate the actuator and control the orientation of valves 20, 30, 50, 60 in response to the communication signal received by the receiver and in response to an indication of the presence of at least one subterranean fluid provided by the sensor.

The sensor of the actuators of the present disclosure can be used to sense heat, pressure, light, or other parameters of the subterranean well, wellbore, or fluid therein. In one embodiment the sensor includes a plurality of differential pressure transducers positioned in the subterranean well at a plurality of subterranean depths. The sensor can provide indication of the presence of the at least one subterranean fluid in response to or by sensing the change in conductivity of the subterranean fluid to be removed. The sensor can provide indication of the presence of the at least one subterranean fluid in response to or by sensing the change in capacitance of the subterranean fluid to be removed.

In another embodiment, an actuator for controlling the orientation of valves 20, 30, 50, 60 of system 1 includes a local electrical power source (as disclosed in the aforementioned embodiments above) for powering the actuator, a controller (as disclosed in the aforementioned embodiments) responsive to a communication signal, and a sensor (as disclosed in the aforementioned embodiments) interfaced with the controller for providing an indication of the presence of at least one subterranean fluid to be removed from a the subterranean well. In this embodiment, a receiver is not required for controlling the orientation of valves 20, 30, 50, 60. A microprocessor of the controller can be programmed to operate the actuator and control the orientation of valves 20, 30, 50, 60 in response to an indication of the presence of at least one subterranean fluid provided by the sensor. The sensor can provide indication of the presence of the at least one subterranean fluid in response to or by sensing the change in conductivity of the subterranean fluid to be removed. The sensor can also provide indication of the presence of the at least one subterranean fluid in response to or by sensing the change in capacitance of the subterranean fluid to be removed.

Figure 3:
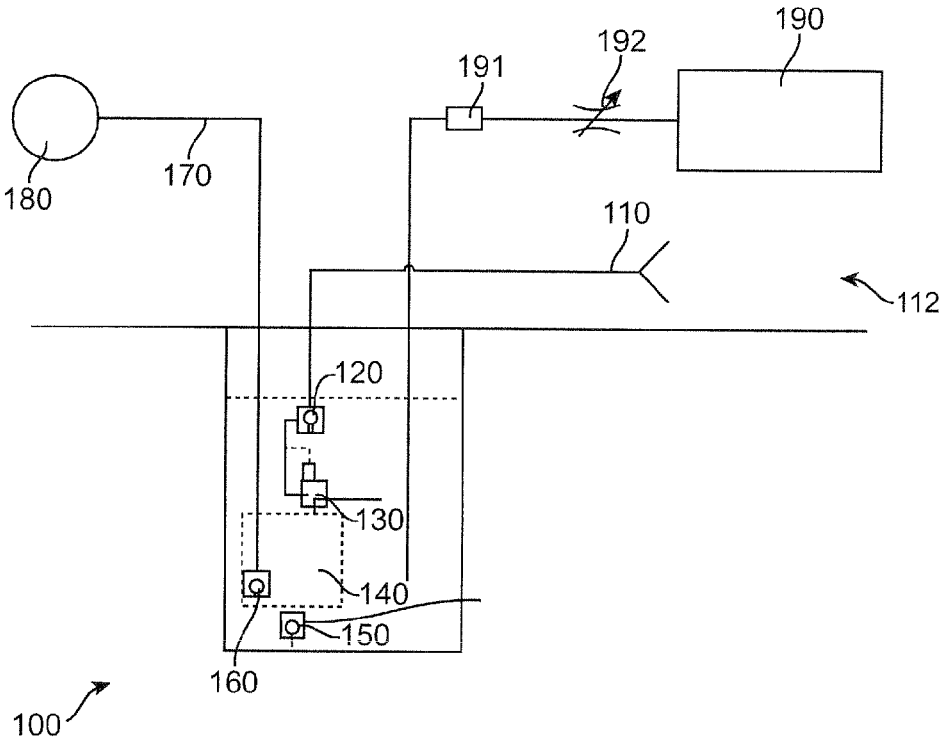
FIG. 3 illustrates an exemplary system for removing fluid from a wellbore according to another embodiment.

FIG. 3 illustrates an exemplary system 100 for removing fluid from a wellbore according to another embodiment. The operation of the system 100 and the removal of fluid from within a well or wellbore can be controlled with the injection of gas through an injection conduit 110. The injection conduit 110 is connected to or in fluid communication with an injection valve 120 which is in fluid communication with a relief valve 130 that provides fluid access to a container 140. A container valve 150 connected to or in fluid communication with the container 140 provides a point of access for fluid from the wellbore entering the container 140. A return valve 160 provides fluid access to a return conduit 170.

In general operation, the system or tool 100 is lowered into a wellbore to a point wherein the container valve 150 is at least in contact with a fluid to be removed. The system 100 can also be lowered almost all the way through the fluid layer or lowered until the container valve 150 is partially, substantially or completely submerged in the fluid. The system 100 can also be lowered into a fluid layer to be removed at a depth sufficient to withdraw fluid through the container valve 150 and partially, substantially or completely fill the container 140.

When the container 140 contains fluid to be withdrawn, or when fluid removal operations are to commence, a high pressure gas supply 112 supplies gas through injection conduit 110. The gas acts upon the injection valve 120 (typically deflecting a compression spring that has been set to a predetermined load and spring rate based on the wellbore depth and the system parameters). Gas flows past the injection valve 120, acts upon a relief valve 130 and urges the relief valve 130 downward. Pressure below the relief valve 130 and in the container 140 can for example be at or about wellbore hydrostatic pressure before pressurization from gas flowing from the injection conduit 110. As the relief valve 130 is urged open, the injection valve 120 opens to provide fluid communication with the container 140 while simultaneously isolating the container from the remainder of the wellbore by closing at least one vent port (or other sealing means) on the container 140.

As the container 140 is pressurized with high pressure gas, the container valve 150 closes to isolate the container 140 from the wellbore and the hydrostatic pressure therein. The return valve 160 opens as soon as the hydrostatic pressure in the return conduit 170 is overcome by the injection pressure in the container 140. In operation, all the fluid in the container 140 and some of the injection gas can be flowed into the return conduit 170 until the injection pressure drops to a pressure that is greater than the hydrostatic wellbore pressure by an amount equal to the re seating pressure differential for the injection valve 20 defined by the preset force in spring 28. In operation, only a portion or substantially all of the fluid to be removed can be flowed from the container 140 into return conduit 170.

A controller 190 can be provided for automatically or manually controlling the flow of gas injected into the injection conduit 110 by actuating the opening and closing a metering control valve 192. A pressure transducer 191 can be arranged at the surface or in the wellbore to provide pressure data through a control line or data line to the controller 190. The pressure transducer 191 can be used to measure pressure downhole in the wellbore, pressure in the container 140, pressure in the injection conduit 110 or pressure within any other volume of the system 100. The pressure data can be used to determine the volume or pressure of injected gas needed to remove the desired fluid from the wellbore. The injection gas can be continually flowed or injected into the wellbore in pulses. The removed fluid and or residual or entrained injection gas can be flowed out of the wellbore and stored in a surface holding tank 180 for subsequent processing or separation. An automated process for controlling and operating the systems herein can utilize algorithms designed for the particular well, by simple timed controls, and/or the like.

Figure 4:
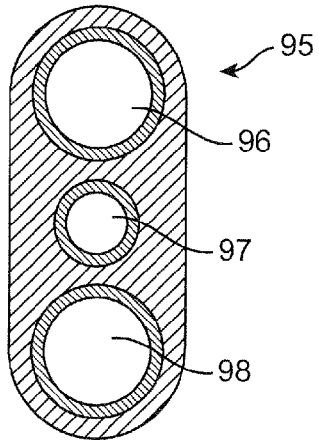
FIG. 4 illustrates of an exemplary harness that operable with the systems disclosed herein for removing fluid from a wellbore.

FIG. 4 illustrates an exemplary harness that can be used with the systems disclosed herein for removing fluid from a wellbore such as the systems illustrated in FIGS. 1-3 and 5-6. The harness can be, for instance a flat pack 95 for use with a fluid removing system having an umbilical arrangement of conduits or lines. The flat pack 95 can include three passageways or holes 96, 97, and 98. A flat pack is not a necessary feature for operation of the systems and processes for removing fluid from a wellbore disclosed herein but it is a convenient manner of organizing conduits running down the wellbore and/or borehole. In general, a flat pack is an extruded packaging for conduits running downhole. In further embodiments, the flat pack 95 is constructed with reinforced metal. At least one injection conduit 95 and one return conduit 98 can be arranged within at least two of the passageways or holes 96, 97, and 98 of the flat pack 95. In various embodiments a control conduit 97 is arranged within at least one of the passageways or holes 96, 97, and 98 of the flat pack 95. Flat packs 95 are capable of use in a casing string to organize, orient, align, and/or group various conduits running downhole. Generally, the flat pack 95 fits within the production string. The injection conduit 10, return conduit 70, and/or measurement conduit 90 (shown in FIG. 1) can be run through the flat pack 95.

Umbilicals disclosed herein can be made of any suitable material, as is common in the art. Typically, the umbilicals are made out of a thermoplastic. Umbilicals can include at least one stainless steel tube encapsulated in a thermoplastic carrier. However, in general, the material(s) for constructing umbilicals are dependent upon various parameters of the well, wellbore, formation or operation(s) being conducted therein. Umbilicals can be any diameter desired, such as, but not limited to ⅝ inch, ⅞ inch, ⅜ inch, ½ inch, ¼ inch, 2 cm, 2.2 cm, 1.5 cm, and/or the like. Generally the size of the umbilical is limited by the space in the casing which is often dependent upon what else is being run downhole.

Figure 5:
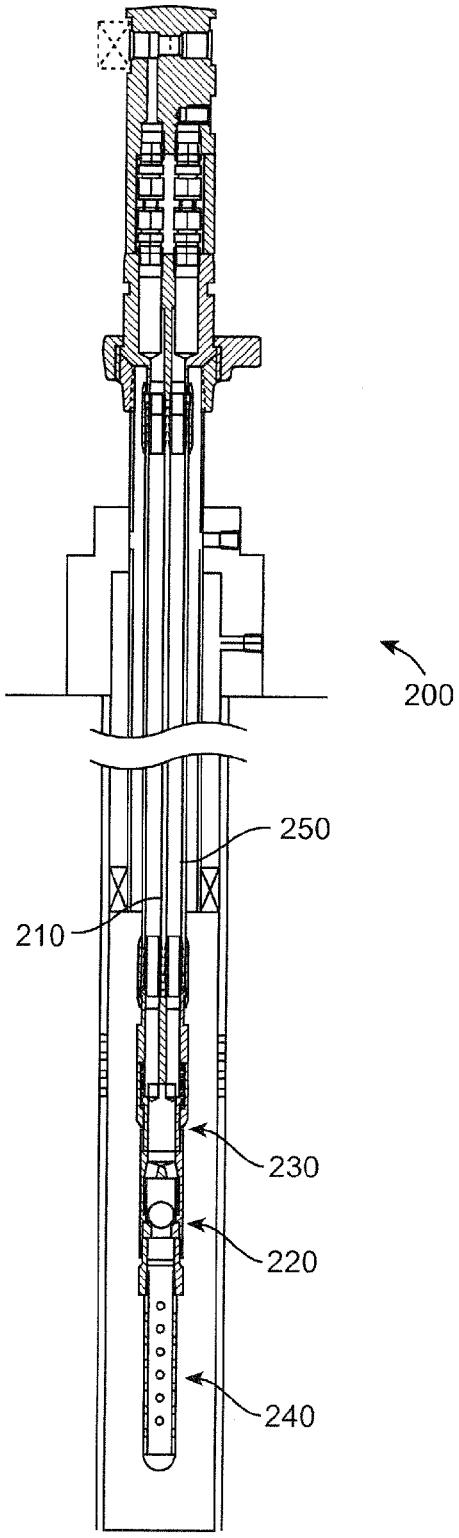
FIG. 5 illustrates a cross sectional view of an exemplary system for removing fluid from a wellbore according to another embodiment.

FIG. 5 illustrates a cross sectional view of an exemplary system 200 for removing fluid from a wellbore according to another embodiment. System 200 comprises an injection conduit 210, a valve 220, a container 230, at least one fluid access port 240, and a return conduit 250.

Fluid is allowed to flow past the valve 220 and up the return conduit 250 and injection conduit 210. When gas is injected down the injection conduit 210, the valve 220 prevents the fluid from exiting the bottom of the system by closing the valve 220. A sufficient amount of gas pressure is built up in the injection conduit 210 to flow fluid from injection conduit 210 and into return conduit 250. At the time the gas exits the bottom of return conduit 250, at least a portion of the fluid is standing in the return conduit 250 and the hydrostatic head of the fluid column is approximately twice what it was before injection began. At this point the injection gas begins to lift the fluid up return conduit 250. As a design consideration, tests have shown that the smaller the diameter of return conduit, the greater the efficiency of fluid removal from the wellbore.

The systems for removing fluid from a wellbore disclosed herein can be controlled or operated manually or automatically. Control for the flow of the gas into an injection conduit can be accomplished with manual or automated control methods. An automated process for controlling and operating the systems herein can utilize algorithms designed for the particular well, by simple timed controls, and/or the like.

Figure 6:
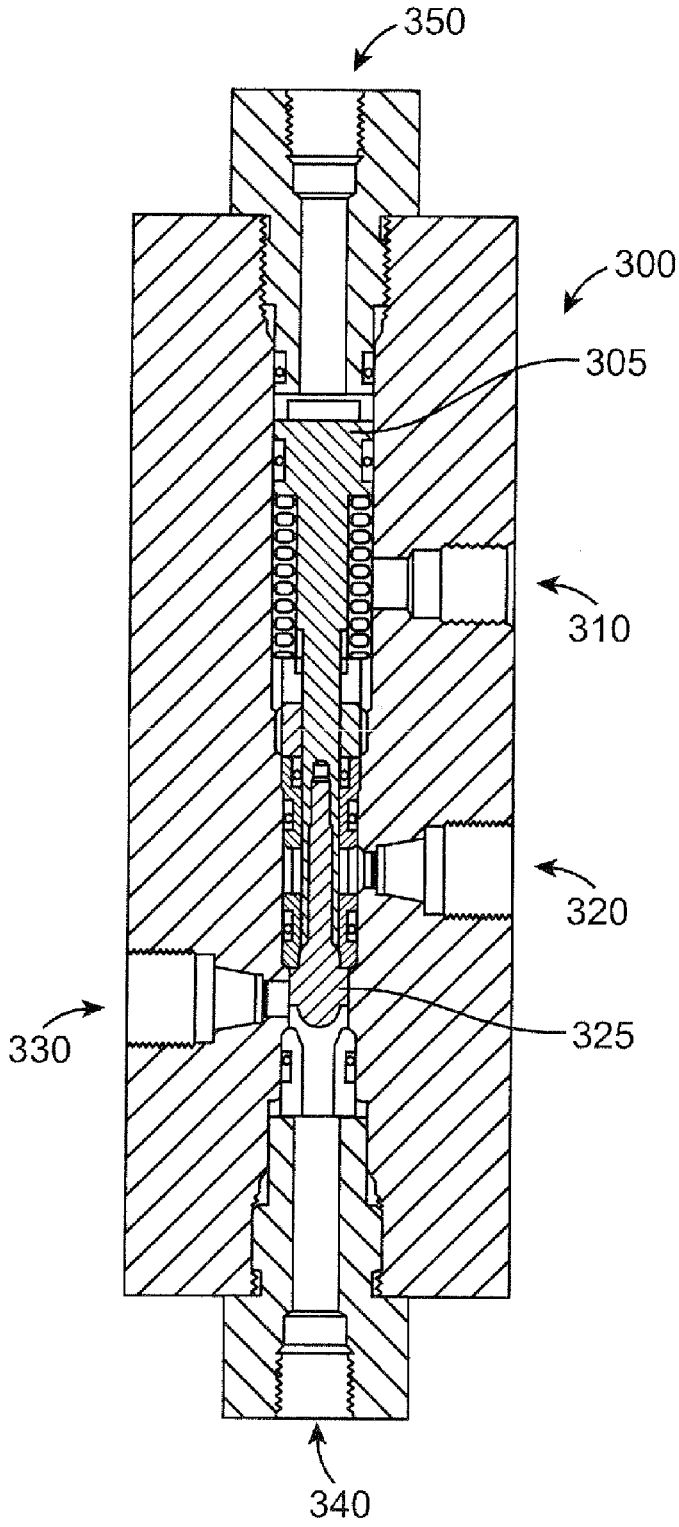
FIG. 6 illustrates a cross sectional view of an exemplary system for removing fluid from a wellbore according to another embodiment.

FIG. 6 illustrates a cross sectional view of an exemplary system 300 for removing fluid from a wellbore according to another embodiment. The down-hole packaging and configuration for the system 300 utilizes a one or a series of three-way, two-position spool valves. The components of operation of the system 300 can include a relief port 310, an injection port 320, a container port 330, a return port 340, and a plug 325. A control line 350, such as an electrical line, hydraulic line, coaxial line, fiber optic line, and/or the like can be used to control a piston 305, such as through a solenoid or other type of motor. In general, in a first position or state, vent port 320 is closed. In a second position or state, container port 330 is closed. In a third position or state, return port 340 is open. In a fourth position or state, container fill port 330 is open and vent port 310 is open to provide fluid communication with container port 330.

When the pressure is bled down on a hydraulic line 350 a container vents gas through vent port 340, then the container fills with fluid through a standing valve. When the hydraulic line 350 is pressured sufficiently above the hydrostatic pressure of the well, the spool valve shifts and the injection port 320 opens to allow fluid communication to the top of the container. A return conduit can be provided at the bottom of the container and therefore the fluid in the container will be forced into the return conduit.

A secondary check valve can be provided at the bottom of the return conduit to prevent the fluid from returning to the container when pilot pressure is removed for the container fill cycle. A pilot line 350 can also be provided for bleeding down a substantially incompressible fluid for a predetermined period of time.

The pressure activated spool valve(s) can be replaced by a solenoid driven valve (SOV) and the pilot control line 350 could be replaced with a conductive i-wire commonly used for deploying downhole instrumentation in a well. The application of current to the i-wire operates the solenoid and the two-position three-way valve. Such an arrangement would be very responsive to a control signal in a time domain. A dedicated control line is required for such an arrangement in addition to an injection conduit and a return conduit. In the case of the SOV, if additional functions of down-hole measurement are also desired, both the SOV activation and the data measurement can be facilitated to provide a very desirable control arrangement.

Figure 7:
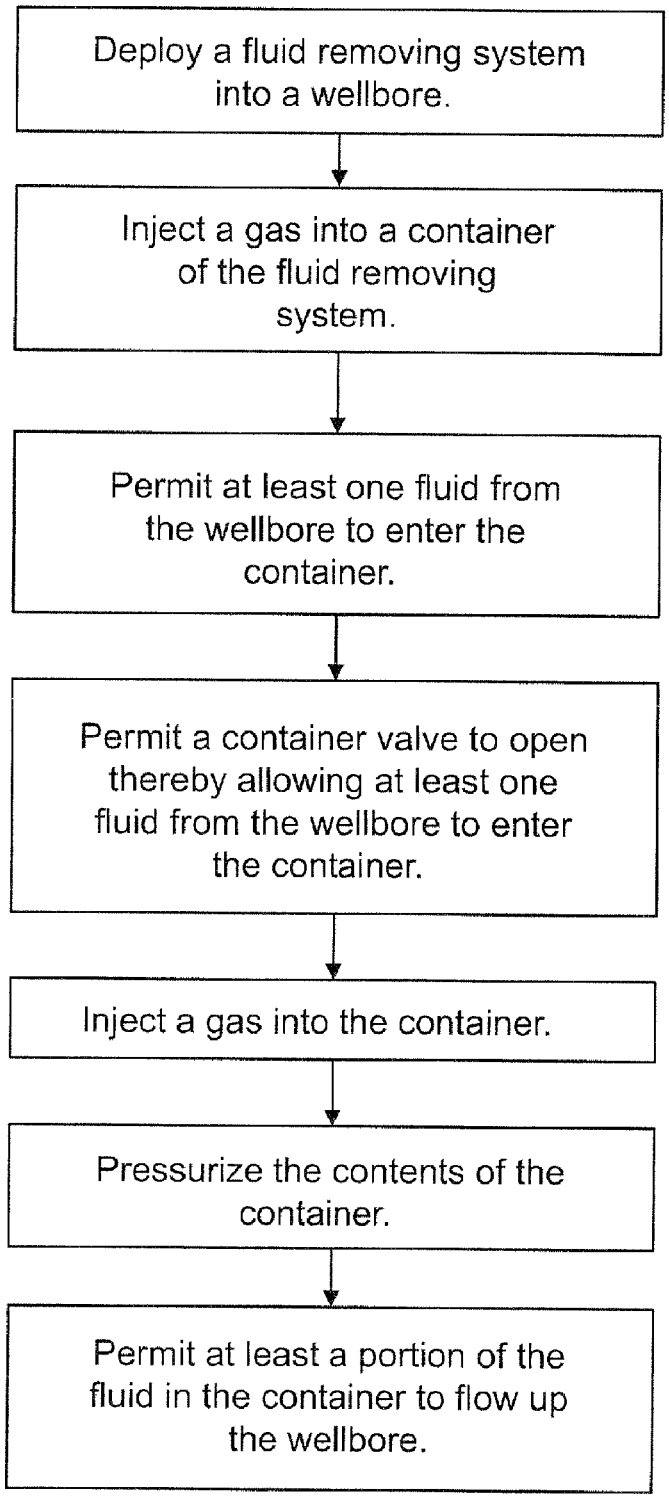
FIG. 7 illustrates a flow chart of an exemplary process for removing fluid from a wellbore according to one embodiment.

FIG. 7 illustrates a flow chart of an exemplary process for removing fluid from a wellbore according to one embodiment. A fluid removing system or tool is lowered into a wellbore or well drilled in a subterranean formation. The system can include in combination, an injection conduit, an injection valve, a relief valve, a container, a container valve, a return conduit valve, and a return conduit that is deployed and positioned within a wellbore drilled in a subterranean formation. The container valve remains in the open position as long as the wellbore hydrostatic pressure is greater than the pressure of a gas in the injection conduit. The container is at least partially filled and can be substantially or fully filled with one or more fluids from within the wellbore entering the container through the container valve.

The system of the present disclosure can positioned in a subterranean well by spooling the system into the subterranean well through a production tubing without disturbing the production tubing. The system of the present disclosure can also be positioned in a subterranean well by spooling the system within the subterranean well with a wellhead injection system. The system can be made to fit in a surface lubricator and spooled therein prior to and during operation of the system. The system can be positioned in the subterranean well at a depth sufficient to reduce the standing level of the subterranean fluid to be removed to a level lower than at least one perforation in the subterranean well or casing. By reducing the standing level of the subterranean fluid, hydrocarbons including oil and gas can be produced from a substantially dry perforation to enhance recovery thereof. The system can be positioned in the subterranean wherein at least one valve (e.g., container valve) is positioned at a subterranean depth lower than at least one perforation to also reduce the standing level of the subterranean fluid to enhance recovery of hydrocarbons including oil and gas from a substantially dry perforation penetrating the subterranean well and in fluid communication with the formation. The system can be also positioned in the subterranean wherein at least one valve (e.g., container valve) is positioned at a subterranean depth lower than the downhole end of tailpipe.

Gas is injected through the injection conduit of at a pressure sufficient to partially, substantially or fully open the injection valve thereby providing fluid access to the container. When the pressure within the container reaches and/or exceeds the hydrostatic pressure of the well the container valve closes. The container is filled with a volume of injected gas sufficient to actuate the closing of the container valve and one or more fluids from the wellbore are contained within the container.

The contents of the container including the injected gas and one or more contained fluids from the wellbore are pressurized to a pressure sufficient to overcome the hydrostatic pressure of the wellbore and open a return valve. At least a portion of one or more fluid that was contained and pressurized in the container is permitted to flow through a return conduit fluidly connected to the open return valve.

The process can be repeated as necessary to remove at least a portion of one or more fluids from the wellbore. As such, an umbilical connection may be combined with the injection valve to maintain the injection conduit in an energized to a desired pressure. The relief valve allows compressed gas into a container when energized and when de-energized, allows the gas to bleed off into the wellbore. The container provides a chamber that is hydrostatically filled with fluid from the wellbore where the fluid can then be pressurized and removed from the well through differential pressure driven flow. The container valve opens and allows fluid in from the bottom of the container when the gas is bled off and closes when the container is pressurized. The return valve (e.g., one-way valve) allows fluid and/or gas into the return conduit when the container is pressurized and prevents the fluid from flowing back into the container once the pressure starts to bleed off.

Specifically, with reference to FIGS. 1 and 2, a process employing the systems disclosed herein is performed by injecting high pressure through the injection conduit 10 acting on the plug 24 of injection valve 20 to deflect a compression spring 28 that is set to a predetermined load and spring rate based on the wellbore depth. As gas flows past the plug 24 and the plug seat 22, the cavity containing the compression spring 28 and the side port 26 communicating into the plug seat 22 become pressurized. The gas pressure in the spring cavity acts on first injection valve seal 12 and on second injection valve seal 14 to further deflect the compression spring 28, increase the flow area between the plug 24 and plug seat 22 and delay injection valve 20 closure. In various embodiments, there is a port 16 located between first injection valve seal 12 and on a second injection valve seal 14 which vents to the wellbore and provides an additional piston affect. The pressure in the spring cavity also goes downward thru a hole in the adjusting rod 33 and acts on the relief valve seal 37 to deflect a spool spring 32 and shift spool 34 downward. Pressure below spool 34 and in container 40 will be at or about wellbore hydrostatic pressure. As the spool 34 shifts downward, a side port 38 in fluid communication with the injection valve 20 opens in fluid communication with the container 40 while simultaneouslyisolating the container by closing the relief port 30.

The container 40 is pressurized with gas, the container valve 50 seats firmly and seals to isolate the container 40 from the wellbore hydrostatic pressure. The return valve 60 opens as soon as the hydrostatic pressure in the return conduit 70 exceeds by the injection pressure in the container 40. At least a portion of the fluid in container and some of the injection gas flows into return conduit 70 until the injection pressure drops to or near the hydrostatic pressure of the wellbore. This pressure equilibrium results from the injection pressure acting on the piston area between first injection valve seal 12 and on second injection valve seal 14 biasing the compression spring 28.

A secondary piston area can be used to maintain the injection valve 20 in an open position to a certain pressure below the valve cracking pressure. The desired amount of pressure drop is adjusted based on the size of container 40 and the amount of gas available in injection conduit 10. Specifically, the minimum cracking pressure of injection valve 20 is set to a value that is equal to or greater than the maximum possible hydrostatic pressure in the return conduit 70 when full plus the amount of pressure drop that occurs when the gas expands into container 40. As the gas expands into container 40 and pushes the fluid out into return conduit 70, the gas pressure will decrease until the spring force overcomes the pressure acting on the piston area between first injection valve seal 12 and on second injection valve seal 14 allowing the injection valve 20 to re-seat and seal.

Once the injection valve 20 re-seals, the gas pressure in the spring cavity and container 40 will go near balance, the spring 28 will shift the relief valve 30 upwards, close the container gas port 38 and open the container vent port 31 simultaneously. The pressurized gas remaining in container 40 will bleed-off into the wellbore until the fluid hydrostatic pressure in the wellbore biases the container valve 50 open and the container 40 starts to re-fill with at least one fluid from the wellbore. The injection conduit 10, in the mean time, is being re-energized with gas and the cycle will start again when injection valve 20 cracks open. In this way, the process for removing fluid from the wellbore is a continuous process.

While the embodiments herein have been described with a certain degree of particularity, it is manifest that many changes may be made in the details of construction and the arrangement of components therein without departing from the spirit and scope of this disclosure. It is understood that the disclosure is not limited to the embodiments set forth herein for the purposes of exemplification, but is to be limited only by the scope of the attached claim or claims, including the full range of equivalency to which each element thereof is entitled.

What is claimed is:

1. A tool capable of being spooled into a fluid layer through a production tubing without disturbing the production tubing for removing fluid from a subterranean well to allow enhanced hydrocarbon production through a production string comprising:

a container positioned in a subterranean well;

a gas injection conduit, independent from the production string, in fluid communication with the container for providing a fluid path for injecting an injection gas from an earth surface proximate location into the container;

a fluid return conduit, independent from the production string, in fluid communication with the container for providing a fluid path for transferring at least one subterranean fluid from the container to an earth surface proximate location;

a gas injection valve that defines an interface between the gas injection conduit and the container;

a relief valve that defines an interface between the subterranean well and the container;

a return valve that defines an interface between the fluid return conduit and the container; and, a container valve that defines an interface between the subterranean well and the container; wherein the relief valve is positioned on the system at subterranean depth above the container valve, wherein the gas injection conduit and the fluid return conduit are within the tool, and further comprising a gas injection valve orientation, wherein the gas injection valve and the return valve are closed, and the relief valve and container valve are open, resulting in fluid entering the return conduit; and, a second valve orientation, wherein the gas injection valve and the return valve are open, and the relief valve and container valve are closed; and wherein the second valve orientation pressurizes the container.

2. The tool as recited in claim 1, further comprising:

a first hydraulic umbilical; and, a hydraulic actuator for controlling the orientation of at least one of the gas injection, relief, return or container valves and responsive to a hydraulic power signal sent through the first hydraulic umbilical from an earth surface proximate location.

3. The tool as recited in claim 1, further comprising a hydraulic actuator for controlling the orientation of at least one of the gas injection, relief, return or container valves and responsive to a hydraulic power signal sent through the gas injection conduit from an earth surface proximate location.

4. The tool as recited in claim 1, further comprising:

an electrically conductive umbilical and an electric actuator for controlling the orientation of at least one of the gas injection, relief, return or container valves and responsive to an electrical power signal sent through the electrically conductive umbilical from an earth surface proximate location.

5. The tool as recited in claim 1, further comprising:

an actuator for controlling the orientation of at least one of the gas injection, relief, return or container valves comprising:

a communications receiver for receiving a communication signal sent from an earth surface proximate location; a local electrical power source for powering the actuator; and a controller responsive to the communication signal sent from an earth surface proximate location.

* * * * *